United States Patent [19]

Dick

[11] 4,446,402

[45] May 1, 1984

[54] PLANAR AC PLASMA DISPLAY HAVING GLOW SUPPRESSOR ELECTRODE

[75] Inventor: George W. Dick, Sinking Springs, Pa.

[73] Assignee: Bell Telephone Laboratories, Incorporated, Murray Hill, N.J.

[21] Appl. No.: 362,097

[22] Filed: Mar. 26, 1982

[51] Int. Cl.[3] ..... H01J 61/04

[52] U.S. Cl. ..... 313/586

[58] Field of Search ..... 313/584, 585, 586, 587

[56] References Cited

U.S. PATENT DOCUMENTS

| | | | |
|---|---|---|---|
| 3,666,981 | 5/1972 | Lay | 313/584 |
| 3,811,061 | 5/1974 | Nakayama et al. | 313/582 X |
| 3,849,694 | 11/1974 | Harvey et al. | 313/519 |
| 3,885,195 | 5/1975 | Amano | 313/485 X |
| 3,933,921 | 11/1976 | Robinson | 313/586 |
| 3,935,494 | 1/1976 | Dick et al. | 313/587 |
| 4,100,447 | 7/1978 | Tsui et al. | 313/586 X |
| 4,164,678 | 8/1979 | Biazzo et al. | 313/582 |

OTHER PUBLICATIONS

SID Digest, issued Apr. 1981, T. Shinoda et al., pp. 164–165, "Characteristics of Surface Discharge color AC-Plasma Display Panels".

*Primary Examiner*—Palmer C. Demeo

*Attorney, Agent, or Firm*—John A. Caccuro

[57] ABSTRACT

In a planar ac plasma panel, display cells are formed by the intersection of row and column conductors which are embedded at lower and upper levels, respectively, in a single dielectric layer which adjoins an ionizable display gas. A glow suppression pad, embedded at the upper level, is located adjacent each display cell. The glow suppression pad is capacitively biased from the row and column electrodes at a voltage which prevents unwanted ionization of the display gas between adjacent display cells.

25 Claims, 4 Drawing Figures

PLANAR AC PLASMA DISPLAY HAVING GLOW SUPPRESSOR ELECTRODE

TECHNICAL FIELD

This invention relates to planar ac plasma displays and more particularly to apparatus for preventing glow spreading in such displays.

BACKGROUND OF THE INVENTION

In planar ac plasma displays, as opposed to twin substrate ac plasma displays, all the electrodes are disposed on one substrate, typically a glass plate. The electrodes are typically embedded within a dielectric layer disposed on the glass plate. As taught, for example, in my U.S. Pat. No. 4,164,678 issued on Aug. 14, 1979, the row and column electrodes can be embedded at lower and upper levels respectively, with a dc isolated conductive pad electrode at the upper level located above and capacitively coupled to the lower row electrode. In such an arrangement, a display site or glow cell is formed on the top surface of the dielectric located between the conductive pad and the column electrode. When biased by placing the proper voltages on the appropriate column and row address electrodes, the display gas located over the display cell ionizes creating a glow.

In ac plasma display designs, it is a continuing problem to further improve the operating margin against unwanted ionization discharge or glow spread between a biased display cell and an adjacent unbiased display cell. This glow spread or crosstalk is undesirable since it reduces the operating voltage margin and the resolution of the ac plasma display. Prior art attempts to prevent glow spread included the use of column and row glow suppression electrodes which are interleaved with the display cell column and row electrodes and are either left floating or connected to a common voltage source. Fabrication and end interconnection of these column/row suppression electrodes adds additional crossover and other complexities to the design of the ac plasma display. Panel fabrication yields could be reduced by possible line-to-line shorts via these column/row suppression electrodes. Additionally, these grounded or floating column/row glow suppression electrodes interspersed with the column/row electrodes produce an unwanted additional capacitive loading on the column/row address line (column electrodes), resulting in larger writing currents to operate the glow cells.

SUMMARY OF THE INVENTION

In accordance with the present invention, the complexities and difficulties of prior methods of eliminating glow spread are eliminated by using a glow suppression pad which is dc isolated and capacitively biased from the row and column electrodes at a voltage which will not initiate or support a glow discharge. When utilized with my above-identified patented display cell, a glow suppression pad is located at the same level as the column electrode and on the side of the column electrode opposite the conductive pad electrode. When a glow suppression pad is utilized with a two-element display cell formed by an upper level column electrode and a lower level row electrode, the glow suppression pad is located adjacent the upper level column electrode. In both applications, the glow suppression pad has a predetermined width and is located a predetermined distance from the upper level electrode. The glow suppression pad is capacitively coupled, approximately equally, to both the lower level row electrode and the upper level column electrode using one or two lower level supplementary conductive pads. As a result the glow suppression pad is capacitively biased at a voltage midway between the dc voltage on the lower level row electrode and the upper level column electrode. Thus, the resultant electric field in the display gas between the column electrode and the conductive pad electrode is insufficient to ionize the display gas.

In another arrangement contemplated by the present invention, glow suppression pads are used to prevent unwanted glow at a crossover formed by a row and column electrode. In that application, the glow suppression pads are located in parallel with and on both sides of the upper level column electrode.

BRIEF DESCRIPTION OF THE DRAWING

The detailed description of the invention will be more fully appreciated from the illustrative embodiment shown in the drawings in which.

DETAILED DESCRIPTION

Figure 1:
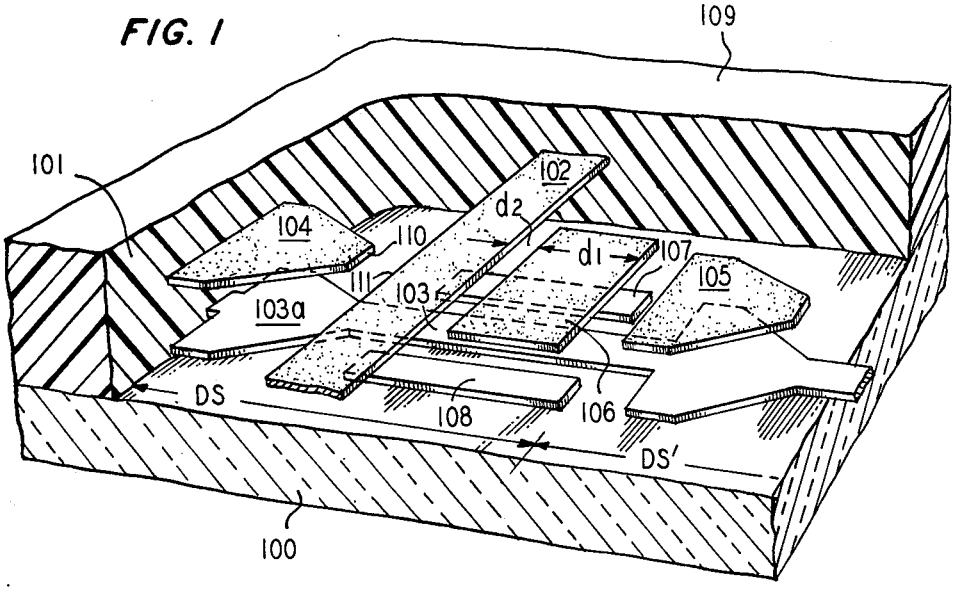
FIG. 1 is a perspective view of a glow suppression electrode as used with a display cell of an ac plasma panel.

As can be seen from FIG. 1 of the drawings, there is illustrated a perspective view of a display cell of a planar ac plasma display apparatus embodying my present invention. The partial cutaway view permits a clear view of the electrodes (used interchangeably herein with the word conductors) of an individual display cell (site) and includes a substrate 100 and dielectric layer 101. A cover plate, not shown, covers dielectric layer 101 and encloses a body of ionizable gas between it and the surface 109 of dielectric layer 101. The ionizable gas may be, for example, a mixture of neon and one-tenth percent argon at a pressure of 500 Torr. Typically, both the cover plate and substrate 100 are a glass plate. The dielectric material can be any of a variety of well-known materials such as, for example, Electro-Science Labs M4111C.

Individual display cell or display site DS comprises three elements (electrodes) and is formed by the intersection of row electrode 103 and column electrode 102 and includes glow supporting conductive pad 104. The location of column electrode 102 and glow supporting pad 104 are at the upper level, being somewhat above the lower level of row electrode 103. In such a three-element display cell arrangement, when the display cell is properly biased, gas ionization occurs generally in the area of dielectric surface 109 between edge 110 of glow supporting pad 104 and edge 111 of column conductor 102.

Conductive pads 107 and 108 and glow suppression pad 106 of the present invention are also part of display cell DS and are utilized to limit and/or prevent unwanted gas ionization.

In two-element display cell arrangements, not shown, which do not utilize glow supporting pad 104, gas ionization occurs on dielectric surface 109 in the area where the edges of column conductor 102 form a crossover with row conductor 103. The operation of the present invention described herein is likewise applicable to limiting and/or preventing unwanted gas ionization in these two-element displays. For an example of a two element display cell, see my U.S. Pat. No. 3,935,494 issued on Jan. 27, 1976.

An ac plasma display consists of a matrix of the previously described display cells DS formed by the intersection of row and column electrodes (conductors) with each cell including an associated glow supporting pad. While display cell DS typically includes the intersection of a row and column conductor it is to be understood that a display cell could include two conductors which do not crossover but become more proximate to each other at a display cell location. In such an arrangement, the conductors need not be embedded in the dielectric at different levels but could be located at the same level.

The basic construction and operation of the three-element display cell DS of FIG. 1 is similar to that of the display cell described in my U.S. Pat. No. 4,164,678, issued on Aug. 14, 1979, which description is incorporated by reference herein.

Figure 2:
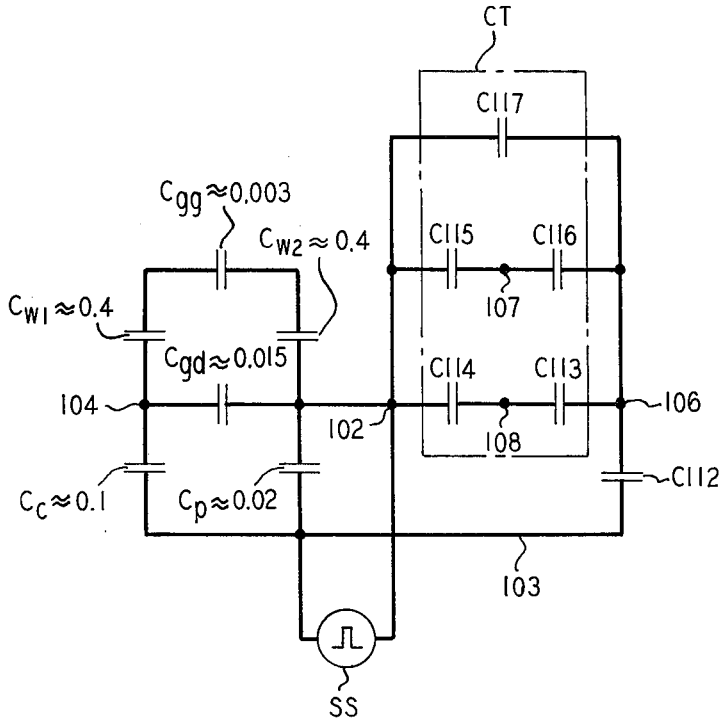
FIG. 2 shows a capacitive equivalent circuit of the display cell of FIG. 1.

The operation of the present display cell DS can also be understood with reference to FIG. 2 which shows capacitive equivalent circuit of display cell DS. The capacitances 112 through 117 are associated with the operation of the disclosed inventive glow suppression and or pad and will be discussed in a later paragraph. The remaining capacitances in the equivalent circuit represent the capacitance between respective pairs of points in the display cell. These include $C_p$, the capacitance between conductors 102 and 103; $C_c$, the capacitance through dielectric layer 101 between conductor 103 and pad 104; $C_{gd}$, the capacitance between pad 104 and conductor 102; $C_{w1}$, the capacitance between pad 104 and dielectric 101/gas interface; $C_{w2}$, the capacitance between conductor 102 and dielectric 101/gas interface; and $C_{gg}$, the capacitance through the display gas from the surface of layer 101 above pad 104 to the surface of layer 101 above conductor 102. The equivalent circuit also includes a signal source, SS, illustratively a write voltage source, connected between the row and column conductors.

When display cell DS is energized the gas between pad 104 and conductor 102 ionizes if the potential exceeds the "breakdown voltage". To effectuate operation at reasonable voltages, the voltage drop between conductor 103 and pad 104 must be small. Thus, as seen from FIG. 2, the value of capacitance $C_c$ is large when compared to that of capacitance $C_{gd}$ taken in parallel with the series combination of capacitances $C_{w1}$, $C_{gg}$ and $C_{w2}$.

To this end, the value of capacitance $C_c$ is made large by forming row conductor 103 such that it has a widened region or pad, 103*a*, which lies directly below, and may illustratively be the same shape as, pad 104. Typical values for the capacitances of the equivalent circuit are shown in FIG. 2. These values are rough calculations arrived at assuming the following physical parameters: Width of conductors 102 and 103, 0.003"; size of pads 103*a* and 104 is 0.010" by 0.010"; width of the gap between conductor 102 and pad 104, 0.003"; total thickness of dielectric layer 101, 0.002"; and distance between upper and lower electrode levels within dielectric layer 101, 0.0015". The values of capacitances $C_{w1}$ and $C_{w2}$, which vary as a function of the amount of wall charge stored, are given at their approximate values. The equivalent capacitance of the network comprised of capacitances $C_{gd}$, $C_{w1}$, $C_{w2}$ and $C_{gg}$ is substantially equal to the value of capacitance $C_{gd}$, which in this example is approximately 0.015 pf. As shown in FIG. 2, the value of capacitance $C_c$ is approximately ten times greater than that of capacitance $G_{gd}$. Thus, any write voltage pulse applied to row conductor 103 is capacitively coupled almost undiminished to pad 104.

The application of write voltage pulses to a display cell DS is described in my above-referenced U.S. Pat. No. 4,164,678. Display cell DS is selected or addressed for operation by application of a write voltage pulse (SS of FIG. 2) across row conductor 103 (and hence pad 104) and column conductor 102. The write voltage pulse (SS) for display cell DS may be generated by applying the voltage pulses $+Vw/2$ and $-Vw/2$ to conductors 103 and 102, respectively. Note, however that all the pads (104, 105, etc.) of display cells along row conductor 103 receive a $+Vw/2$ voltage pulse and that all display cells along column conductor 103 receive a $-Vw/2$ voltage pulse. However, since a display cell requires a write voltage pulse of Vw, only display cell DS located at the intersection of row conductor 103 and column conductor 102 will ignite and produce a light-emitting (ON) glow. The discharge and glow of display cell DS occurs between pad 104 and column conductor 102 in a well-known manner. The glow appears in the ionized gas on the dielectric surface between edges 110 of pad 104 and edge 111 of column conductor 102. Once ignited, a display cell requires further successive sustaining voltage pulses to produce a continuous light-emitting glow. The sustaining ac voltage or bipolar pulses are likewise applied across row conductor 103 (pad 104) and column conductor at a magnitude somewhat less than a write pulse. Note, the magnitude of the sustaining pulses are less than a write pulse and are insufficient to initiate a discharge at the other display cells along row conductor 103 and column conductor 102. A display cell is switched to a non-light-emitting (OFF) state by applying an erase pulse which is insufficient to sustain the display cell in the light-emitting (ON) state.

The discharge or glow created at an ON display cell of a planar ac plasma panel tends to propagate, or spread away from the gap in response to each sustain pulse. Thus, with reference to FIG. 1, the glow between edges 110 and 111 attempts to spread across column conductor 102 to pad 105 of adjacent display cell DS' in the absence of glow suppressor 106. Disadvantageously, in a matrix of display cells glow spread can lead to crosstalk or erroneous ignition of nearby OFF display cells (e.g., DS'). The result is a loss of resolution or definition in the character or graphic being displayed.

In accordance with the present invention this glow spread is inhibited using an individual capacitively coupled glow suppression pad 106 for each display cell. With reference to FIG. 1, the use of an individual capacitively coupled glow suppression pad 106 for each display cell DS obviates the complexities of the prior art method of interspersing glow suppression electrodes between the existing column conductors and providing connection to a common ground or voltage source. Moreover, the disclosed invention eliminates the substantial additional capacitance that the prior art interspersed glow suppression electrodes produced. This additional capacitance significantly loaded the applied write and sustain pulses.

With reference jointly to FIGS. 1 and 2 the function of the disclosed glow suppression pad 106 will be discussed. Glow suppression pad 106 is rectangular in this embodiment and is located on the same level and in parallel with column conductor 102 and on a side opposite the electrode pad 104. Glow suppressor pad 106 is of width d1, which is large enough that a glow will not be established across it. Width d1 is chosen to be greater than the Paschen minimum discharge length for a given pressure. As is well known in the art, the Paschen minimum discharge length is defined as the smallest length which will support a discharge for the given gas type and pressure.

Glow suppression pad 106 is located at a distance d2 from column conductor 102 which is chosen to be smaller than the Paschen minimum, i.e., small enough to prevent much surface field (at the gas and dielectric interface) due to row conductor 103. Glow suppression pad 106 is capacitively coupled in an approximately equal manner to lower level row conductor 103 and the upper level column conductor 102. With reference to FIG. 2 again, the capacitances associated with the glow suppression pad 106 are illustrated. Glow suppression pad 106 is capacitively biased by capacitance CT and capacitor C112 at a voltage approximately midway between the voltages on row conductor 103 and column conductor 102.

Capacitor 112 represents the capacitive coupling between row conductor 103 and suppressor pad 106. Capacitance C117 is the minimal edge capacitance between suppressor pad 106 and column conductor 102. Capacitance C117 is a minimal value (stray capacitance) and does not substantially affect the bias or operation of suppressor pad 106 and is only included herein for completeness. Other stray capacitances which are smaller than capacitance C117 have been excluded from FIG. 2 and the following discussion. In parallel with capacitance C117 are the capacitances C115/C116 and C114/C113, which are formed between the lower level conductive pads 107 and 108 and column conductor 102 and suppressor electrode 106, respectively. Capacitances C115/C116 and C114/C113 are designed to provide substantial capacitance coupling between column conductor 102 and suppressor electrode 102, thus enabling the coupling of ac voltages to suppressor electrode 102. Conductive pad 107 is capacitively coupled to column conductor 102 (C115) and to suppressor electrode 106 (C116). Similarly, conductive pad 108 is capacitively coupled to column conductor 102 (C114) and to suppressor electrode 106 (C113). Obviously, one conductive pad having the appropriate capacitances could be substituted for conductive pads 107 and 108.

With reference to FIG. 2, the total capacitance CT between column electrode 102 and suppressor electrode 106 includes C117 in parallel with both the series combination of C114 and C113 as well as C115 and C116. Depending on the given dielectric 101, the sizes of row and column conductors 102 and 103, and the separation between the upper and lower metalization levels; the size of suppressor electrode 106 and conductive pads 107 and 108 can be determined, in a straightforward manner, to make the total capacitance CT between suppressor electrode 106 and column conductor 102 equal to the capacitance C112 between suppressor electrode 106 and row conductor 103. Thus, with capacitor C112 equal to capacitor CT, the voltage divider formed by capacitor C112 and CT causes the ac voltage on suppressor electrode 106 to be approximately half of the sum of the voltages on row conductor 103 and column conductor 102. Since the writing voltages are $-Vw/2$ and $+Vw/2$, respectively, the voltage on suppressor electrode 106 would be approximately 0 volts. Obviously, the voltage on suppressor electrode would also be approximately 0 volts during sustaining voltage pulses if these were $+Vw/2$ and $-Vw/2$ on the two electrodes, respectively.

While in the preferred embodiment described above, suppressor electrode 106 is approximately equally capacitively coupled to column conductor 102 and row conductor 103, such equality of coupling is not a requirement. More generally, the disclosed invention teaches that suppressor electrode 106 can be biased, using the previously described method, at any voltage between the voltages on column conductor 102 and row conductor 103, by appropriately adjusting the capacitive coupling to these conductors. However, the bias voltage for suppressor electrode 106 should be selected to provide the desired drive voltage operating margins and the desired glow suppression characteristics for the particular display panel application.

It is to be understood that when a two-element display cell is constructed from two conductors which do not intersect but merely become proximate to each other at a display cell location, the disclosed suppressor electrode 106 and conductive pads 107 and 108 are arranged in accordance with the present invention so that suppressor electrode 106 is capacitively biased via a conductive pad at a voltage between (ideally midway) the voltages on the two conductors. In such an arrangement the suppressor electrode 106 would also again prevent an ON display cell from ionizing the display gas of an adjacent OFF display cell. Moreover, if the two conductors forming the display cell are embedded at the same level in the dielectric, other conductive pad embodiments of my glow suppression technique would enable a suppression electrode to be capacitively biased at a voltage approximately midway between the voltage on the two display cell conductors. Again this suppression pad capacitively biased at one-half on the difference between the voltages on the two conductor leads, would prevent an ionization of the display gas. In any of the above described arrangements using my glow suppression method and apparatus it is obvious that such a suppression pad can be located in sections of the planar ac display panel where spurious gas ionization is anticipated.

Figure 3:
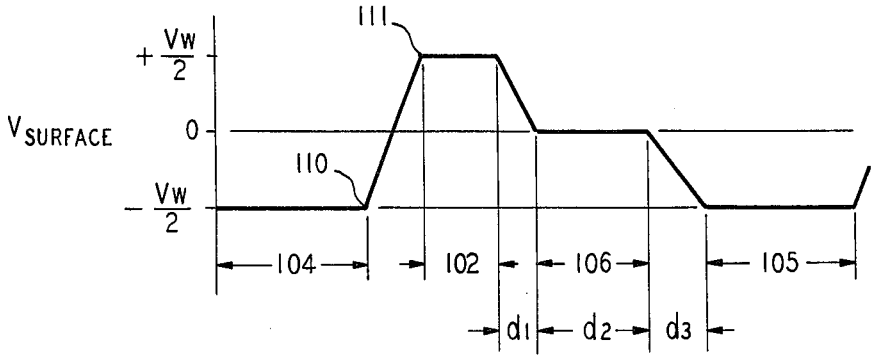
FIG. 3 shows the effective voltage level across the dielectric surface at the display gas interface.

FIG. 3 illustrates the approximate voltages which appear at the dielectric/gas interface 109 for the display cell arrangement shown in FIG. 1. For illustration purposes the voltage transitions are shown as varying in a linear manner, which is approximately correct. The following assumes that a write voltage pulse of $+Vw/2$ and $-Vw/2$ is applied to column and row conductors 102 and 103, respectively. As previously noted, the resulting voltage on electrode pad 104 is also $-Vw/2$. The voltage on the surface of dielectric/gas interface 109 above electrode pad 104 is approximately $-Vw/2$. In the region of the dielectric/gas interface 109 between edge 110 of electrode pad 104 and edge 111 of column conductor 102 the voltage starts increasing toward $+Vw/2$. In this region the voltage increase in an approximately linear manner from the $-Vw/2$ of electrode pad 104 to the $+Vw/2$ of column electrode 102. As previously discussed, it is this large voltage differential which ionizes the gas at the dielectric/gas interface 109 creating the light-emitting glow for display cell DS. Proceeding from edge 111 to the right over dielectric surface 109 the voltage remains approximately constant, at Vw/2, across the width of column electrode 102 section. In the region of the dielectric/gas interface 109 between column electrode 102 and suppressor pad (electrode) 106 the voltage decreases from +Vw/2 towards 0 volts at suppressor electrode 106. No gas ionization occurs in this region near suppressor electrode 106 since the voltage differential between it and either column conductor 102 or electrode pad 104 is only Vw/2 which is insufficient to initiate or support ionization of the gas. Note, the potential difference between suppressor electrode 106 and either column conductor 102 or row conductor 103 is reduced to approximately Vw/4 if column conductor 102 is driven by a negative write pulse of −Vw/2 and row conductor 103 is driven at 0 volts. Note, that with the prior art, long electrode (floating) geometry of glow suppressor, the voltage on the long electrodes will be closer to +Vw/4 rather than zero volts since most of the underlying row conductors are non-selected and at zero volts. Thus, a greater tendancy to form a glow discharge at the d3 edge (FIG. 3) of the suppression electrode would exist for the long electrode geometry. A similar potential difference occurs if row conductor 103 is driven by a write pulse and column conductor 102 is not driven by a write pulse (i.e. at zero volts).

Continuing towards the right the voltage remains constant, at 0 volts, across the width of suppressor electrode 106 and then decreases to −Vw/2 at electrode pad 105 of the adjacent display cell. Despite the fact that a differential voltage of Vw exists between electrode pad 105 and column conductor 102, no spreading occurs since the critical electric field is never exceeded. The electric field is below the critical level because the distance d1+d2+d3 between column conductor 102 and electrode pad 105 is greater than the Paschen discharge distance. While the mode of operation of glow supporting pad 104 does inhibit glow spreading, as described in my previously-identified U.S. Pat. No. 4,164,678, the disclosed suppressor electrode 106 provides significant additional margin against glow spread permitting higher cell density in the display.

Figure 4:
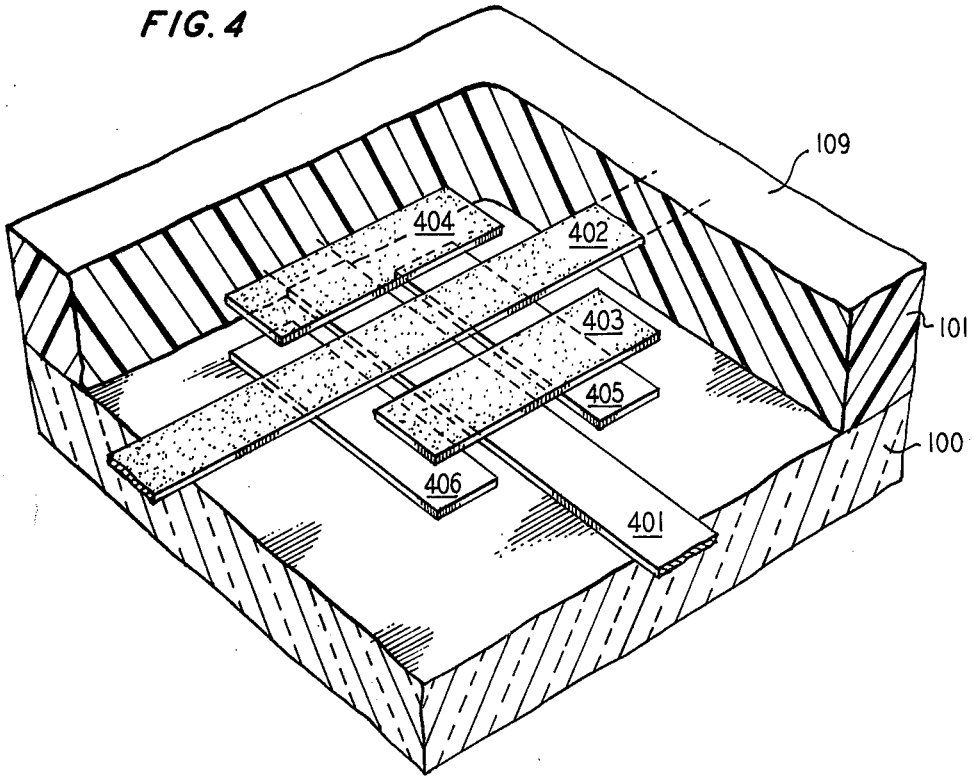
FIG. 4 is a perspective view of a glow suppression electrode as used at a crossover formed by a row and column electrode.

With reference to FIG. 4, an additional important use of the glow stopping electrode 106 is in thin film dielectric construction of a single substrate plasma panel. In single substrate plasma panel construction the back glow, the glow between an upper column conductor and a buried row conductor, is not prevented by the thickness of the dielectric layer. Thus, at crossovers formed between the upper column conductor 402 and the lower row conductor 401 a glow is possible. Since the thickness of the dielectric layer results in only a minimal voltage drop through the dielectric layer, the result is that all of the row conductor drive potential appears at the dielectric/gas interface surface above the buried row conductor, within a few dielectric thickness widths from the top column conductor. The result is that the gas ionizes and a glow exists across the area of the dielectric surface. Using the disclosed glow suppression techniques such unwanted glows can be prevented.

As shown in FIG. 4, the disclosed glow suppression techniques can be utilized to prevent unwanted glow at electrode crossover locations. FIG. 4 illustrates a crossover formed between row conductor 401 and column conductor 402 located, respectively, on substrate 100 and, within dielectric 101. Two glow suppressors electrodes 403 and 404 straddle column conductor 402 at a distance smaller than the Paschen minimum discharge length.

In a manner similar to the previous discussion of pads 107 and 108, conductive pads 405 and 406 provide a capacitive coupling between column conductor 402 and glow suppressor electrodes 403 and 404 which is approximately equal to the capacitive coupling between glow suppressor electrodes 403 and 404 and row electrode 401. Again, the effect of the resulting capacitive voltage divider is that glow suppressor electrodes 403 and 404 are biased midway between the voltage on row conductor 401 and column conductor 402. The resulting voltage difference, during a write pulse applied between row conductor 401 and column conductor 402, between glow suppressor electrodes 403 and 404 and either column conductor 402 or row conductor 401 is approximately Vw/2 maximum, which is insufficient to initiate a glow discharge around column electrode 402. As noted previously, the voltage on glow suppressor electrodes 403 and 404 is approximately 0 or ±Vw/2, depending whether either or both of row conductor 401 and/or column conductor 402 are driven with a write pulse of ±Vw/2. Again, as previously noted, one suitable conductor electrode can replace conductive pads 405 and 406 to provide the desired capacitive coupling from column conductor 402 to glow suppressor electrodes 403 and 404.

Although only particular embodiments of my glow suppression method and apparatus has been disclosed it is obvious that my apparatus is readily adaptable to prevent a spurious glow in other multiple conductor display cell embodiments. Additionally, other glow suppression embodiments known to those skilled in the art could provide similar functions without deviating from the scope of my invention.

What is claimed is:

1. Display cell apparatus comprising a dielectric layer having a planar surface, an enclosed body of ionizable gas adjacent said surface, first and second conductors embedded in said layer, and a single glow suppression pad capacitively coupled to said first and second conductors biasing said glow suppression pad at a voltage intermediate the voltage on said first and second conductors.

2. The display cell apparatus of claim 1 wherein said glow suppression pad is approximately equally capacitively coupled to said first and second conductors.

3. The display cell apparatus of claim 2 wherein said first and second conductors are embedded in said layer at first and second levels therewithin, respectively, said second level being more proximate to said body of ionizable gas than said first level, and said glow suppression pad is located on the same level and adjacent said second conductor.

4. The display cell apparatus of claim 3 further comprising a glow supporting pad disposed in said layer at said second level adjacent to said second electrode on a side opposite the location of said glow suppression pad and substantial capacitively coupled to said first electrode.

5. The display cell apparatus of claim 3 wherein said first and second conductors are elongated in shape and disposed substantially at right angles to one another.

6. The display cell apparatus of claim 3 further comprising at least one conductive pad located on the same level as said first conductor and having a capacitive coupling to both said second conductor and said glow suppression pad.

7. The display cell apparatus of claim 6 wherein said conductive pad has a segment located under said second conductor and a segment located under said glow suppression pad.

8. The display cell apparatus of claim 6 wherein said conductive pad is elongated in shape with the length dimension disposed substantially in parallel with said first conductor.

9. The display cell apparatus of claim 3 wherein said glow suppression pad is elongated in shape with the length dimension substantially in parallel with said second conductor.

10. The display cell apparatus of claim 3 wherein said glow suppression pad is located at the Paschen minimum distance from said second conductor and has a width greater than the Paschen minimum distance.

11. Display apparatus comprising a planar substrate;

a planar layer of dielectric material disposed on said substrate;

an enclosed body of ionizable gas adjacent said layer;

a first plurality of conductors embedded in said layer;

a second plurality of conductors embedded in said layer forming a plurality of display cells with said first plurality of conductors;

a plurality of individual glow suppression pads with only one suppression pad per display cell which is capacitively coupled to each conductor forming the display thereby biasing each suppression pad at a voltage intermediate the voltage on the conductors coupled thereto.

12. Display apparatus comprising a planar substrate;

a planar layer of dielectric material disposed on said substrate;

an enclosed body of ionizable gas adjacent said layer;

a first plurality of conductors embedded in said level;

a second plurality of conductors arranged substantially perpendicular to said first plurality of conductors forming a plurality of display cells with said first plurality of conductors and embedded in said layer at a second level which is more proximate said body of ionizable gas than said first level; and a plurality of individual glow suppression pads located at said second level, wherein only one suppression pad is capacitively coupled to conductors of each intersection formed by said first and second plurality of conductors.

13. The display apparatus of claim 11 or 12 wherein each of said plurality of glow suppression pads are approximately equally capacitively coupled to conductors of said intersection formed by said first and second plurality of conductors.

14. The display apparatus of claim 11 or 12 further comprising a first plurality of glow supporting pads each disposed in said layer at said second level and adjacent to one of said second plurality of conductors on a side opposite the location of a glow suppression pad and substantially capacitively coupled to one of said first plurality of conductors forming an intersection with said one of said second plurality of conductors.

15. The display apparatus of claim 11 or 12 wherein at least one of said plurality of glow suppression pads is elongated in shape with the length dimension substantially in parallel with and located at the Paschen minimum distance from its second conductor and having a width greater than the Paschen minimum distance.

16. The display apparatus of claims 11 or 12 further comprising a plurality of conductive pads located on the same level as said first plurality of conductors and each of said plurality of conductive pads having a capacitive coupling to both a second conductor and a glow suppression pad of an intersection.

17. The display apparatus of claim 16 wherein each of said plurality of conductive pads have a segment located under said second conductor and a segment located under said glow suppression pad of an intersection.

18. The display apparatus of claim 16 wherein at least one of said plurality of conductive pads is elongated in shape with the length dimension disposed substantially in parallel with a first conductor.

19. Glow suppression apparatus for preventing ionization of a gas at conductor crossover locations of a display apparatus; said display apparatus comprising a dielectric layer having a planar surface;

an enclosed body of ionizable gas adjacent said surface;

first and second conductors embedded in said layer at first and second levels, respectively, forming a non-conductive crossover therein, said second level being more proximate to said body of ionizable gas than said first level; and said glow suppression apparatus comprising two glow suppression pads located on the same level and adjacent each side of said second conductor at said non-conductive crossover, said glow suppression pads being capacitively coupled to said first and second conductors.

20. The glow suppression apparatus of claim 19 wherein each of said two glow suppression pads are approximately equally capacitively coupled to said first and second conductors.

21. The glow suppression apparatus of claim 19 or 20 further comprising at least one conductive pad located on the same level as said first conductors and having a capacitive coupling to one of said second conductors and to one of said glow suppression pads.

22. The glow suppression apparatus of claim 21 wherein said conductive pad has a segment located under one of said second conductors and a segment located under one of said glow suppression pads.

23. The glow suppression apparatus of claim 21 wherein said conductive pad is elongated in shape with the length dimension disposed substantially in parallel with one of said first conductors.

24. The glow suppression apparatus of claim 19 or 20 wherein said glow suppression pads are elongated in shape with the length dimension substantially in parallel with said second conductors.

25. The glow suppression apparatus of claim 24 wherein each of said glow suppression pads are located at the Paschen minimum distance from one of said second conductors and has a width greater than the Paschen minimum distance.

* * * * *